US010923087B2

(12) United States Patent
Balu

(10) Patent No.: US 10,923,087 B2
(45) Date of Patent: Feb. 16, 2021

(54) MELLOPHONE IN REAL F

(71) Applicant: Ion Balu, Cordova, TN (US)

(72) Inventor: Ion Balu, Cordova, TN (US)

( * ) Notice: Subject to any disclaimer, the term of this patent is extended or adjusted under 35 U.S.C. 154(b) by 0 days.

(21) Appl. No.: 16/792,126

(22) Filed: Feb. 14, 2020

(65) Prior Publication Data

US 2020/0265812 A1 Aug. 20, 2020

Related U.S. Application Data

(60) Provisional application No. 62/805,547, filed on Feb. 14, 2019.

(51) Int. Cl.

| | |
|---|---|
| ***G10D 9/03*** | (2020.01) |
| ***G10D 7/10*** | (2006.01) |
| ***G10D 9/11*** | (2020.01) |
| ***G10D 9/04*** | (2020.01) |

(52) U.S. Cl.
CPC ..... *G10D 9/03* (2020.02); *G10D 7/10* (2013.01); *G10D 9/04* (2013.01); *G10D 9/11* (2020.02)

(58) Field of Classification Search
CPC ... G10D 9/03; G10D 7/10; G10D 9/11; G10D 9/04
See application file for complete search history.

(56) References Cited

U.S. PATENT DOCUMENTS

2005/0016356 A1* 1/2005 Shire ..... G10D 9/04 84/395

* cited by examiner

*Primary Examiner* — Kimberly R Lockett
(74) *Attorney, Agent, or Firm* — Brown & Michaels, PC

(57) ABSTRACT

A portable mellophone instrument having two interchangeable leadpipes and pitched in real F. The mellophone plays in the key of real F, and has a stable, deep, mellow sound. The mellophone allows French horn players to use their own mouthpiece to play the mellophone without an adapter, and allows trumpet players to play the mellophone using a familiar mouthpiece.

14 Claims, 13 Drawing Sheets

MELLOPHONE IN REAL F

REFERENCE TO RELATED APPLICATIONS

This application claims one or more inventions which were disclosed in Provisional Application No. 62/805,547, filed on Feb. 14, 2019, entitled "MELLOPHONE IN REAL F". The benefit under 35 USC § 119(e) of the United States provisional application is hereby claimed, and the aforementioned application is hereby incorporated herein by reference.

BACKGROUND OF THE INVENTION

Field of the Invention

The invention pertains to the field of musical instruments. More particularly, the invention pertains to a mellophone in the key of real F.

Description of Related Art

The mellophone is a three-valved brass instrument pitched in the key of F or E♭. While the mellophone is often referred to as being in the key of F, it is actually pitched in F-alto to high F and is therefore playing an octave higher than real F. The mellophone is used as the middle-voiced brass instrument in place of French horns. The mellophone is often carried in marching bands and weighs about 1.58-1.72 kg.

The mellophone has three valves, tubing, and a conical bore. The tubing length of a mellophone is approximately the same as that of the F-alto (high) single horn or the F-alto (high) branch of a triple horn or double-descant horn, which is approximately 1.83 meters long, the same as the French horn in high F as opposed to the 3.66 meters of tubing present in a French horn in normal or real F. Therefore, overtone series of the F mellophone is an octave above that of the French horn. Because the mellophones are carried in the marching band, the tubing is reduced in length to save on weight causing the mellophones to be an octave higher than F. With the mellophone pitched an octave higher, the playing capabilities are limited as the precision of sound (intonation, stability and quality of the low register) and the range of notes a player can adequately play are diminished. With these issues, the mellophone is often out of turn and unstable, destabilizing the entire ensemble in which it is played.

The mellophone uses the same mouthpiece as the alto (tenor) horn, which is in between the size of a trombone and trumpet mouthpiece. Different mouthpieces can be used with the mellophone to alter the sound. One mouthpiece has a deep cup, and has a wider inner diameter than a trumpet mouthpiece. A trumpet-style parabolic ("cup") mouthpiece can also be used. Another mouthpiece used is a smaller, lighter, conical ("funnel") mouthpiece, as used on French horns, with an adapter to allow the mouthpiece to fit in the larger-bore leadpipe of the mellophone. Use of the adaptor with a mouthpiece alters the precision of sound. By making some players use a different mouthpiece, embouchure and sound problems for the players can develop.

SUMMARY OF THE INVENTION

The present invention is directed to a portable mellophone instrument that satisfies the need for a mellophone that plays in the key of real F, has a stable, deep, mellow sound, allows French horn players to use their own mouthpiece to play the mellophone without an adapter, and allows trumpet players to play the mellophone using a familiar mouthpiece.

A portable mellophone instrument comprises a bell attached to a first end of a plurality of tubing. An interchangeable lead pipe is attached to a second end of the plurality of tubing with least one valve formed within the first end and second end of the plurality of tubing. A tuning slide is slidably connected to the piston valve located within the first end and the second end of the plurality of tubing.

DETAILED DESCRIPTION OF THE INVENTION

Figure 1A:
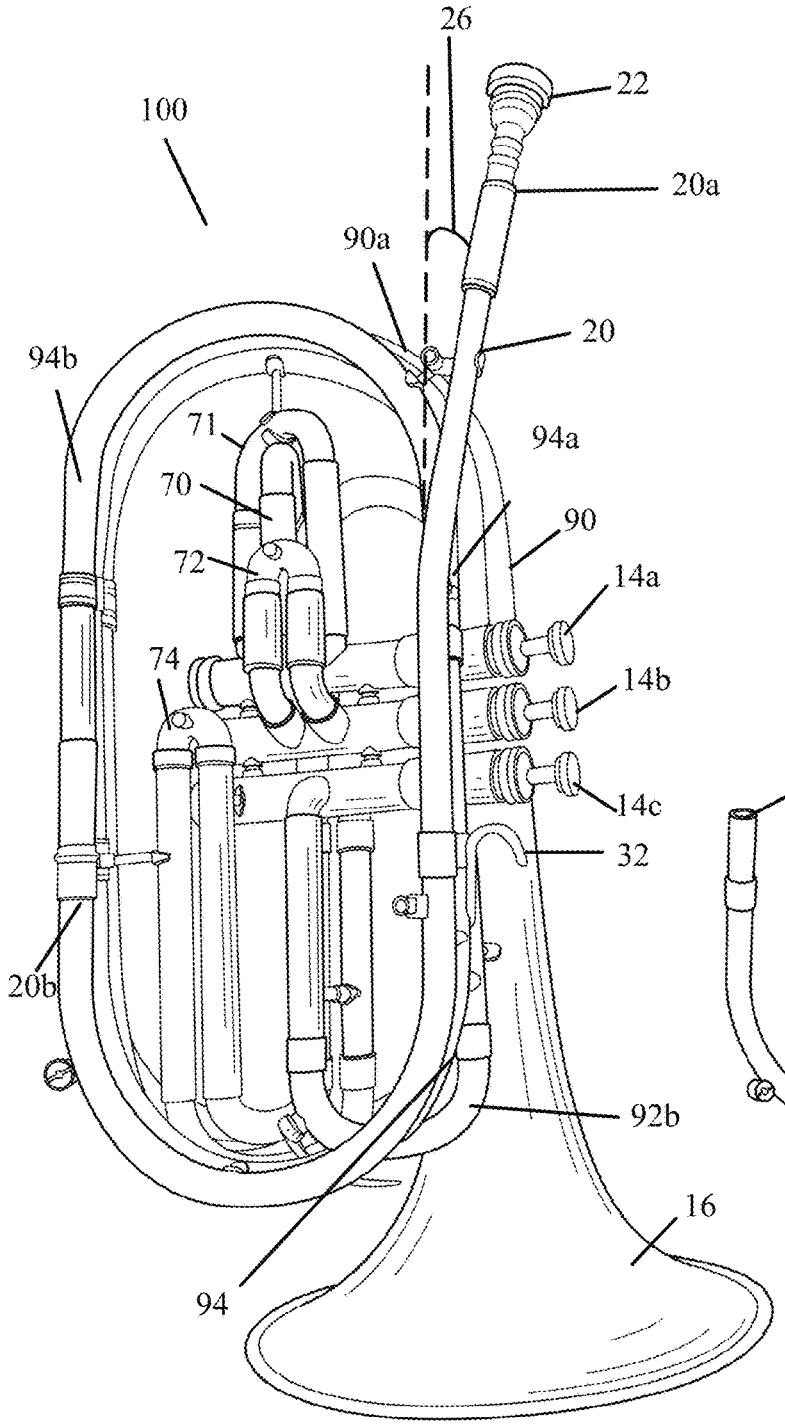
FIG. 1A shows a side view of the mellophone of an embodiment of the present invention with a leadpipe receiving a horn mouthpiece.
Figure 1B:
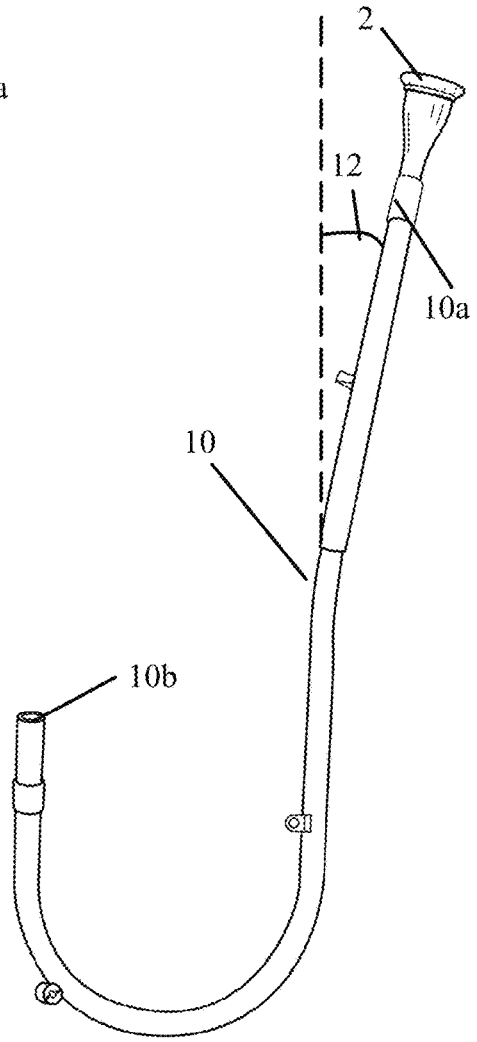
FIG. 1B shows an alternate leadpipe for receiving a trumpet mouthpiece which can be attached to a mellophone of an embodiment of the present invention.
Figure 2:
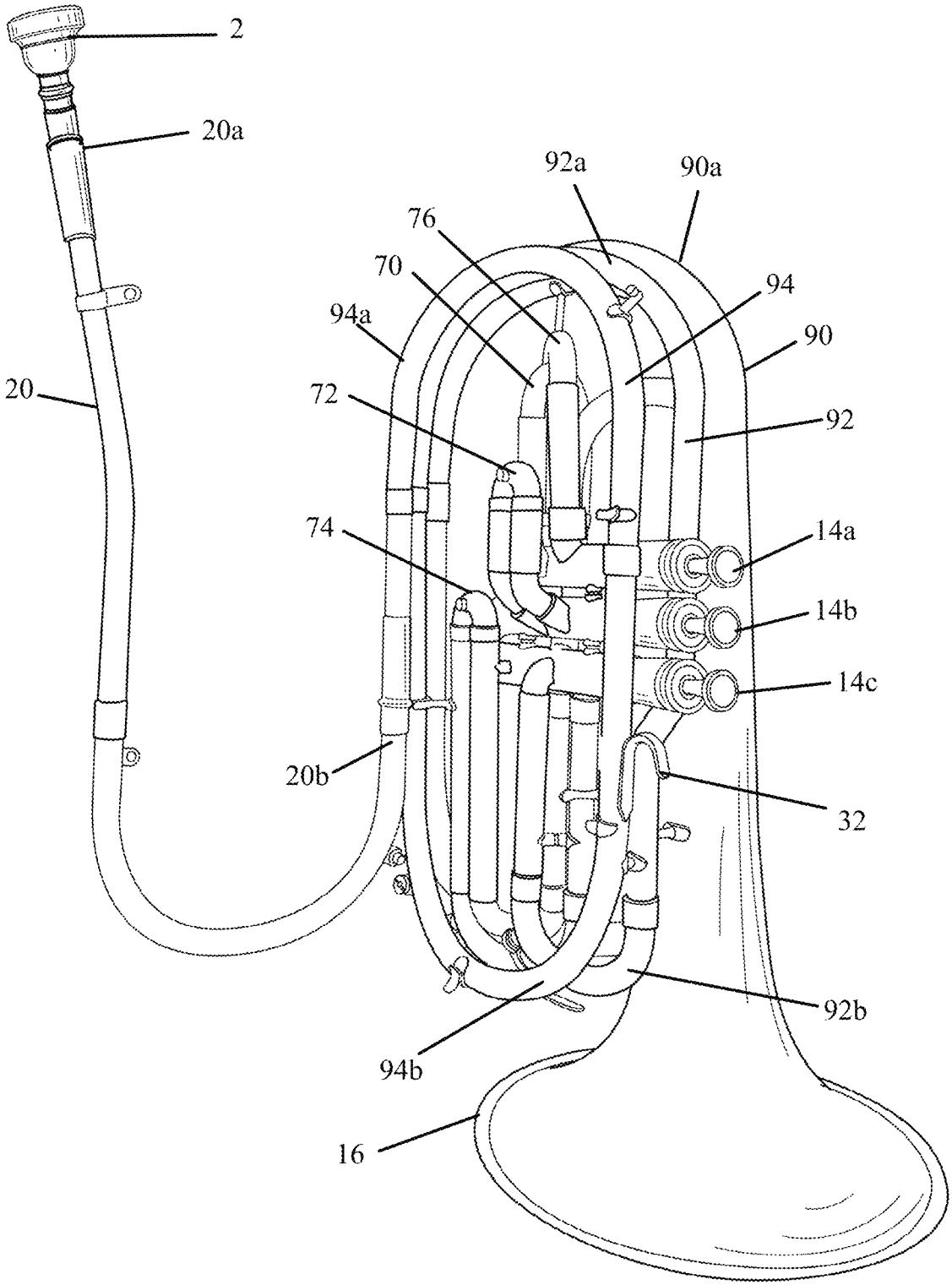
FIG. 2 shows a side view of the mellophone of an embodiment of the present invention with the leadpipe for receiving a trumpet mouthpiece.
Figure 3A:
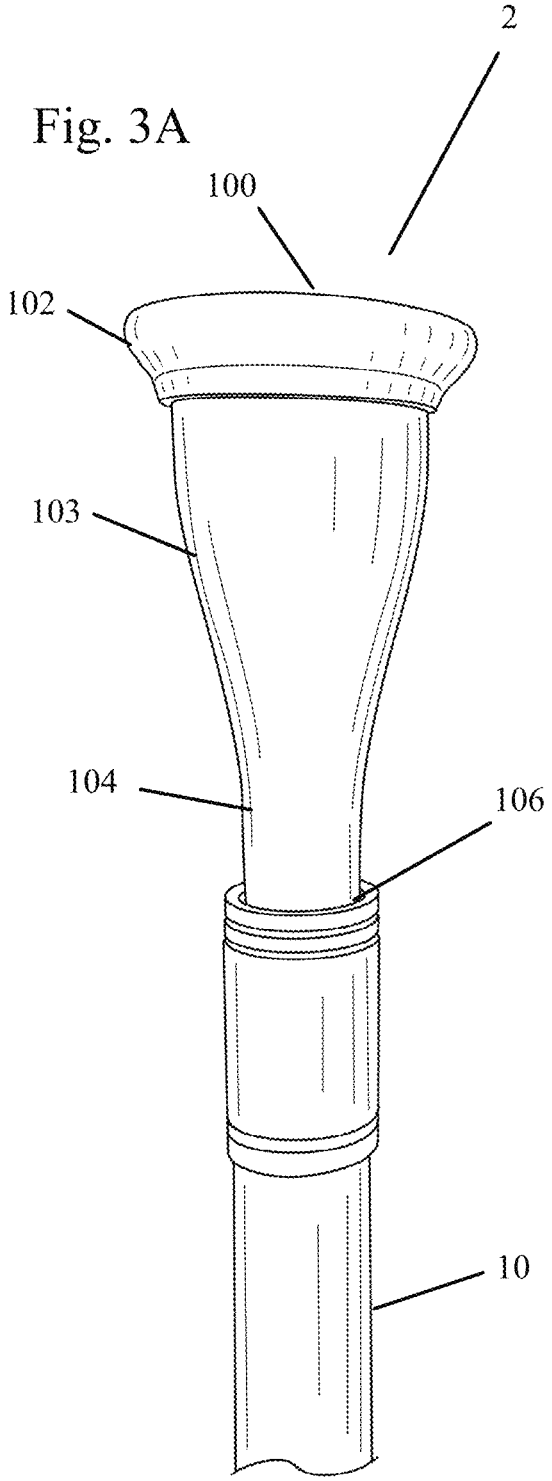
FIG. 3A shows side view of a horn mouthpiece.
Figure 3B:
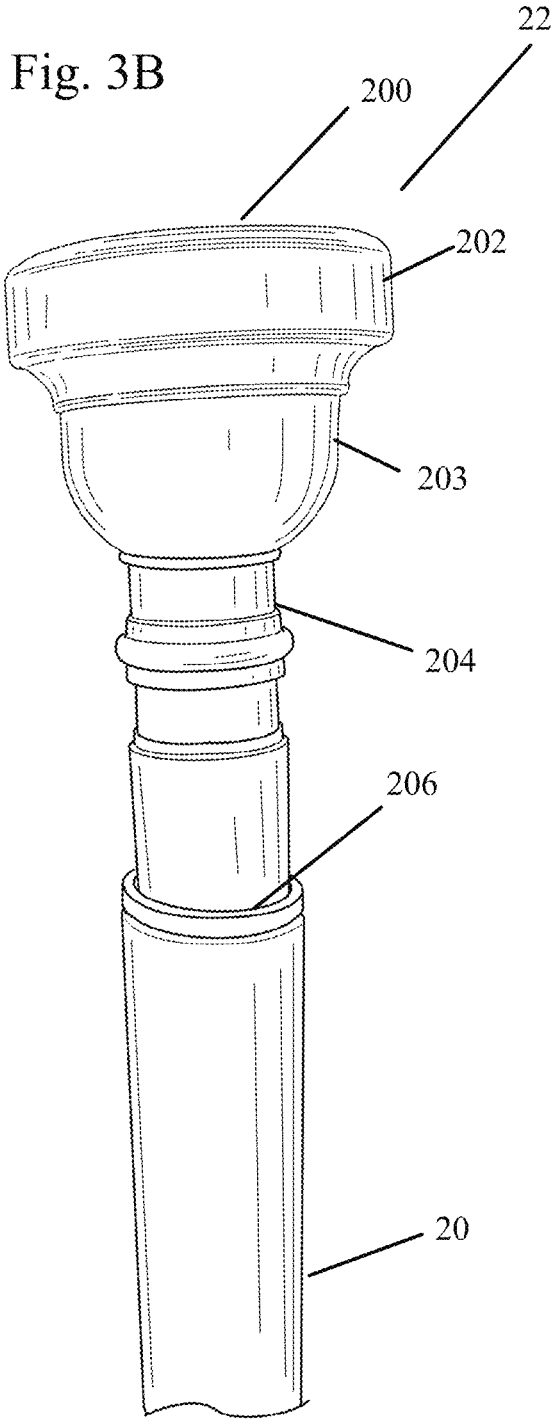
FIG. 3B shows a side view of a trumpet mouthpiece.
Figure 4A:
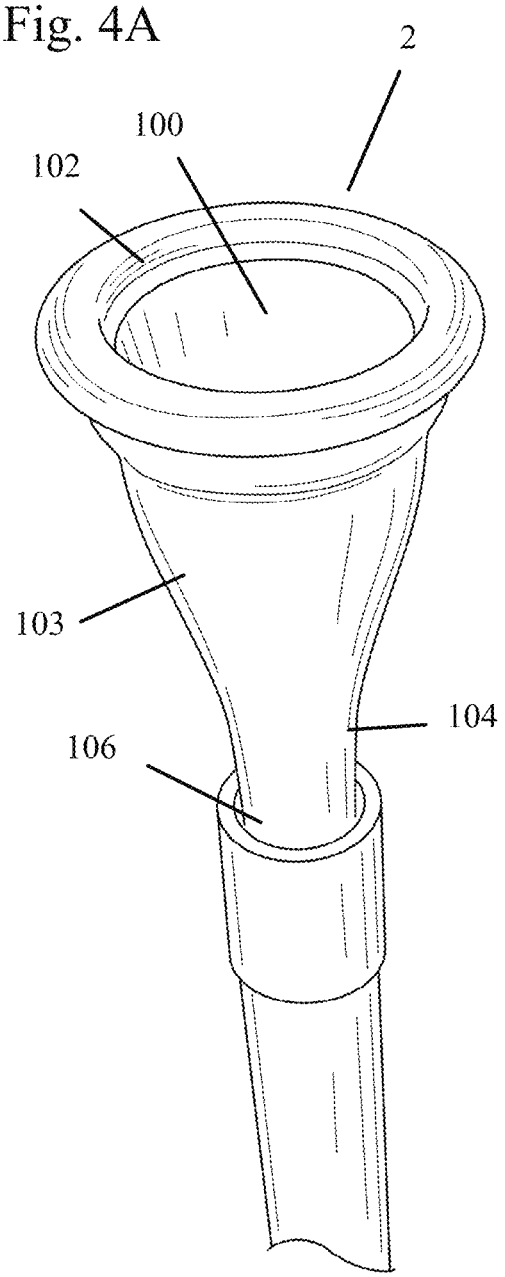
FIG. 4A shows a perspective view of the horn mouthpiece.
Figure 4B:
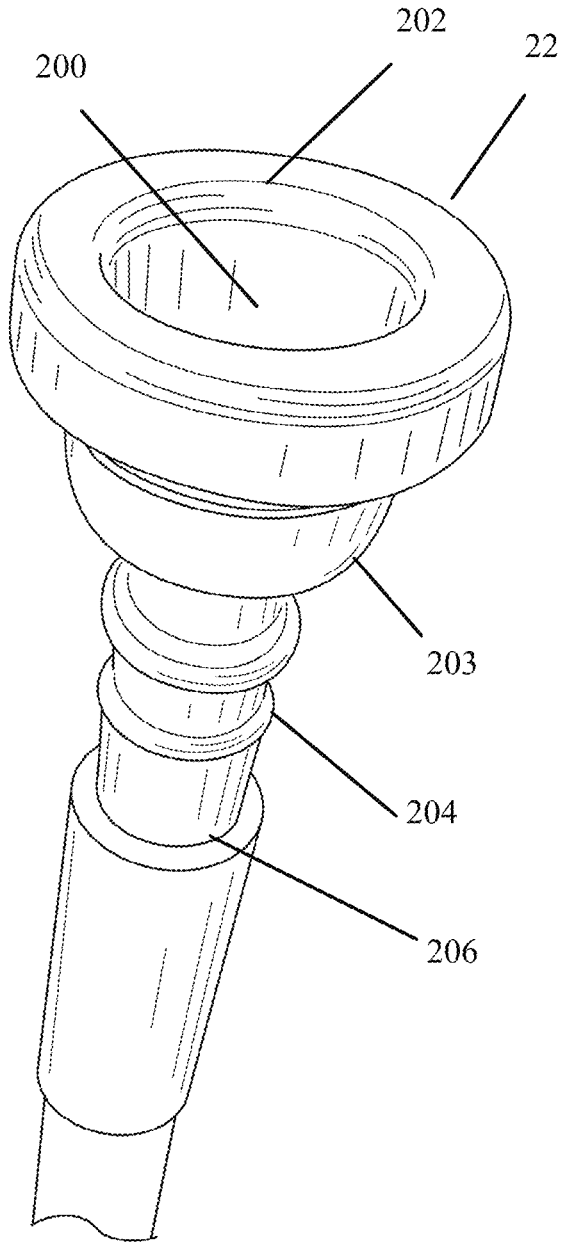
FIG. 4B shows a perspective view of the trumpet mouthpiece.

In the Summary of the Invention above and in the Detailed Description of the Invention, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

The present invention and alternative embodiments provide for a solution to mellophones being pitched in high F or alto F, and for musicians having to use a mellophone mouthpiece or use a horn mouthpiece with an adapter. In an embodiment, the mellophone is a musical instrument which is portable and easy to use for marching bands and pitched in the key of real F. The mellophone of an embodiment of the present invention has the full range of notes that a French horn pitched in the key F does, as well as the precision and stable sound. The mellophone of the present invention is approximately less than 1.81 kg.

FIGS. 1-10 show a mellophone of a first embodiment of the present invention.

The mellophone 1 comprises a bell 16 attached to a first tubing segment 90 and has a first tubing loop segment 90*a*, a second tubing loop segment 90*b*, and a third tubing loop segment 90*c*, connected to piston valve 14*a*. A second tubing segment 92, has a first tubing loop segment 92*a*, and a second tubing loop segment 92*b* which longitudinally extends from piston valve 14*c* and forms a third tubing segment 94. The third tubing segment 94 has a first tubing loop segment 94*a* and a second tubing loop segment 94*b* in which the first end 20*b* of trumpet lead pipe 20 is received. The first end 20*a* of the trumpet lead pipe 20 receives the trumpet mouthpiece 22. When the trumpet lead pipe 20 is connected to the third tubing segment 94, the first end 20*a* of the trumpet lead pipe 20 is at an angle 26 relative to the third tubing segment 94. A pinky ring 32 is also attached to the third tubing segment 94.

The tubing segments 90, 92, 94 of mellophone 1 form a "loop" encircling the tuning slide 70 radially extending from piston valve 14*a*, tuning slide 72 radially extending from piston valve 14*b*, and tuning slide 74 radially extending from piston valve 14*c*. The piston valves 14*a*-14*c* and the associated tuning slides 70, 72, 74 also fit within the "loop" of the instrument allowing the instrument to be balanced when held by the player. By placing the tubing segments 90, 92, 94, the piston valves 14*a*-14*c* and the turning slides 70, 72, 74 within the "loop" of the instrument, the tuning slides 70, 72, 74 and the piston valves 14-*a*-14*c* are protected from dents. Sections of the tubing segments 90, 92, 94 can be soldered (see FIGS. 5 and 8) to each other as well as to the bell 16 of the instrument to eliminate the use of numerous braces required by conventional mellophones and to increase the durability of mellophone 1 to withstand impacts or dents, as an impact is dispersed over a greater area than the area of individual braces closest to the impact. Furthermore, the tubing segments 90, 92, 94 and associated tubing loop segments 90*a*, 90*b*, 90*c*, 92*a*, 92*b*, 94*a* and 94*b* of mellophone 1, of the present invention, combine to total approximately 3.66 meters of tubing. One of ordinary skill in the art understands that the length of tubing determines the pitch of the instrument.

Figure 5:
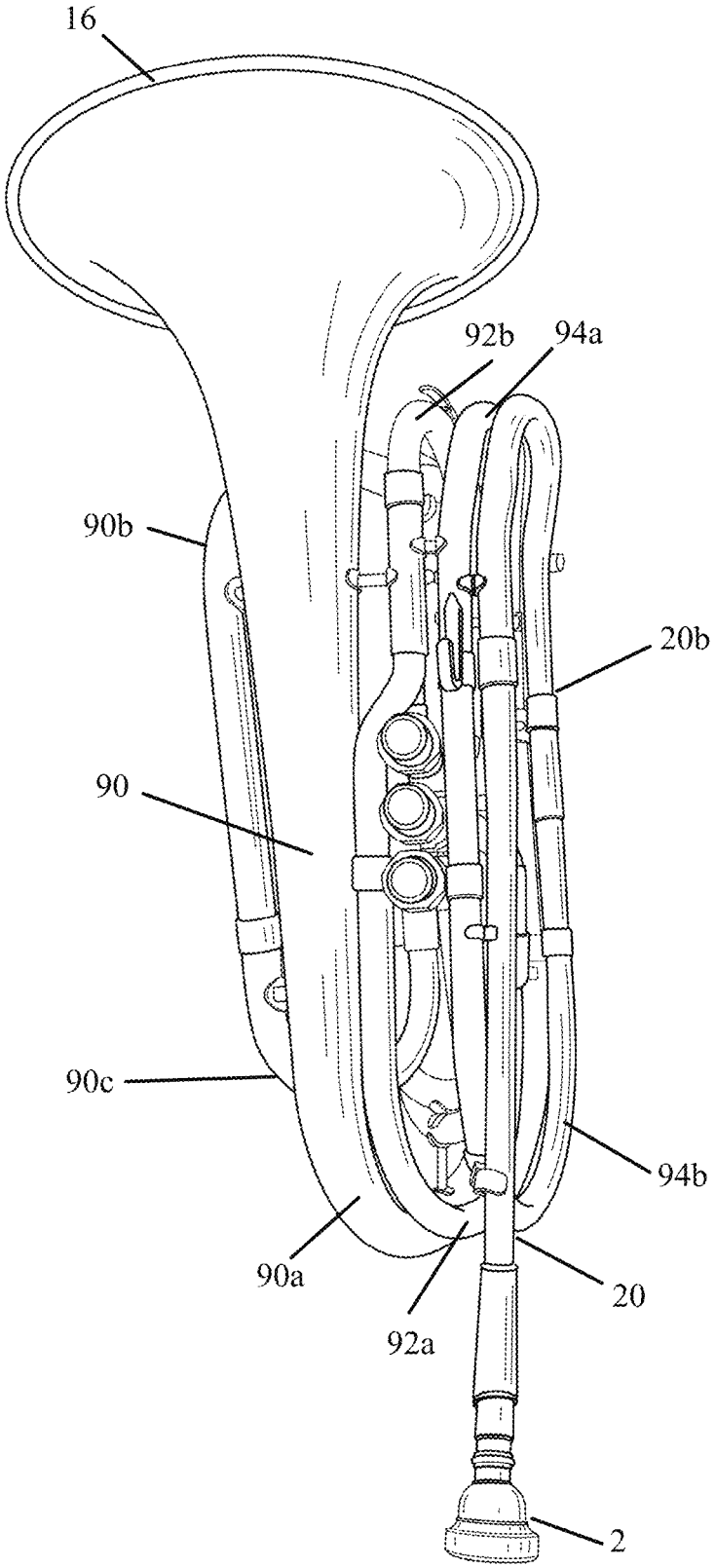
FIG. 5 shows a top view of the mellophone of an embodiment of the present invention.
Figure 6:
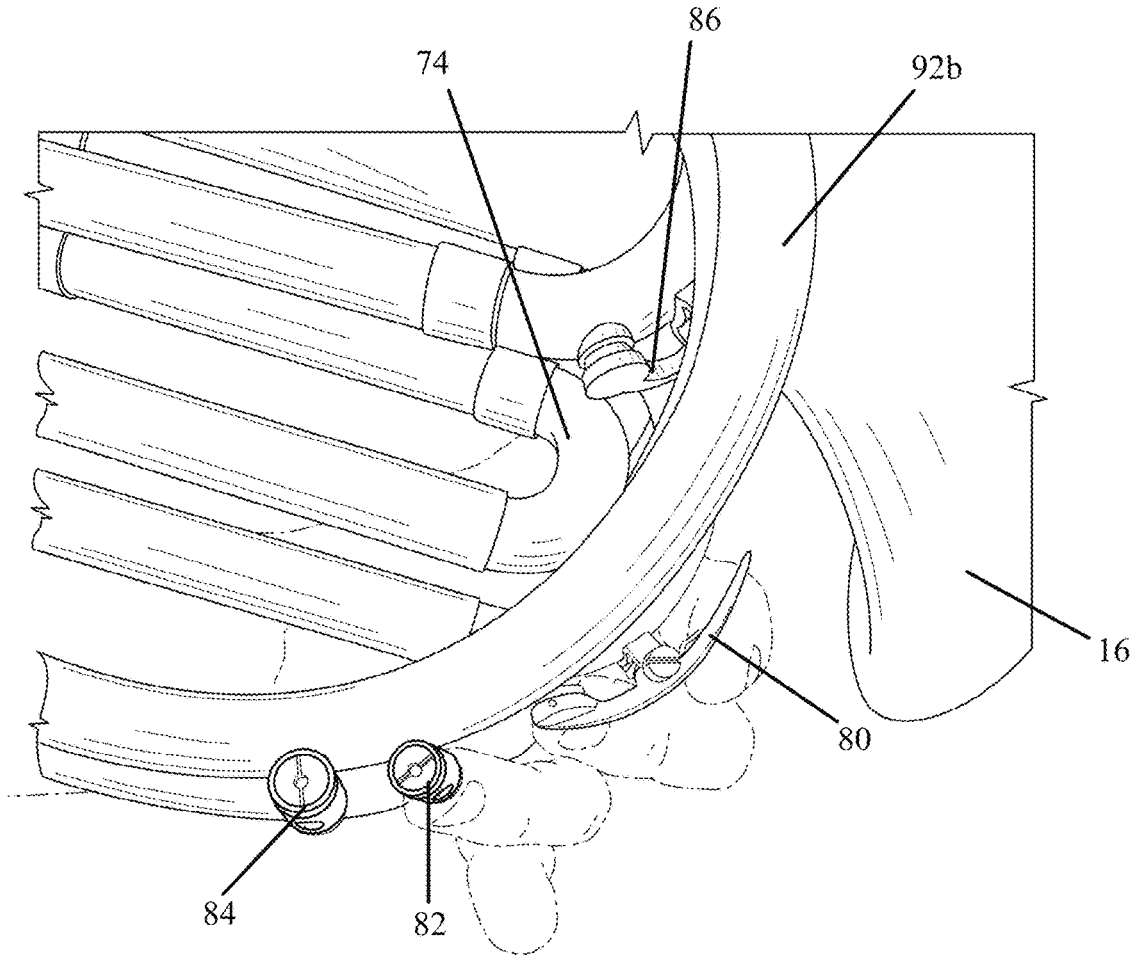
FIG. 6 shows water keys.
Figure 7:
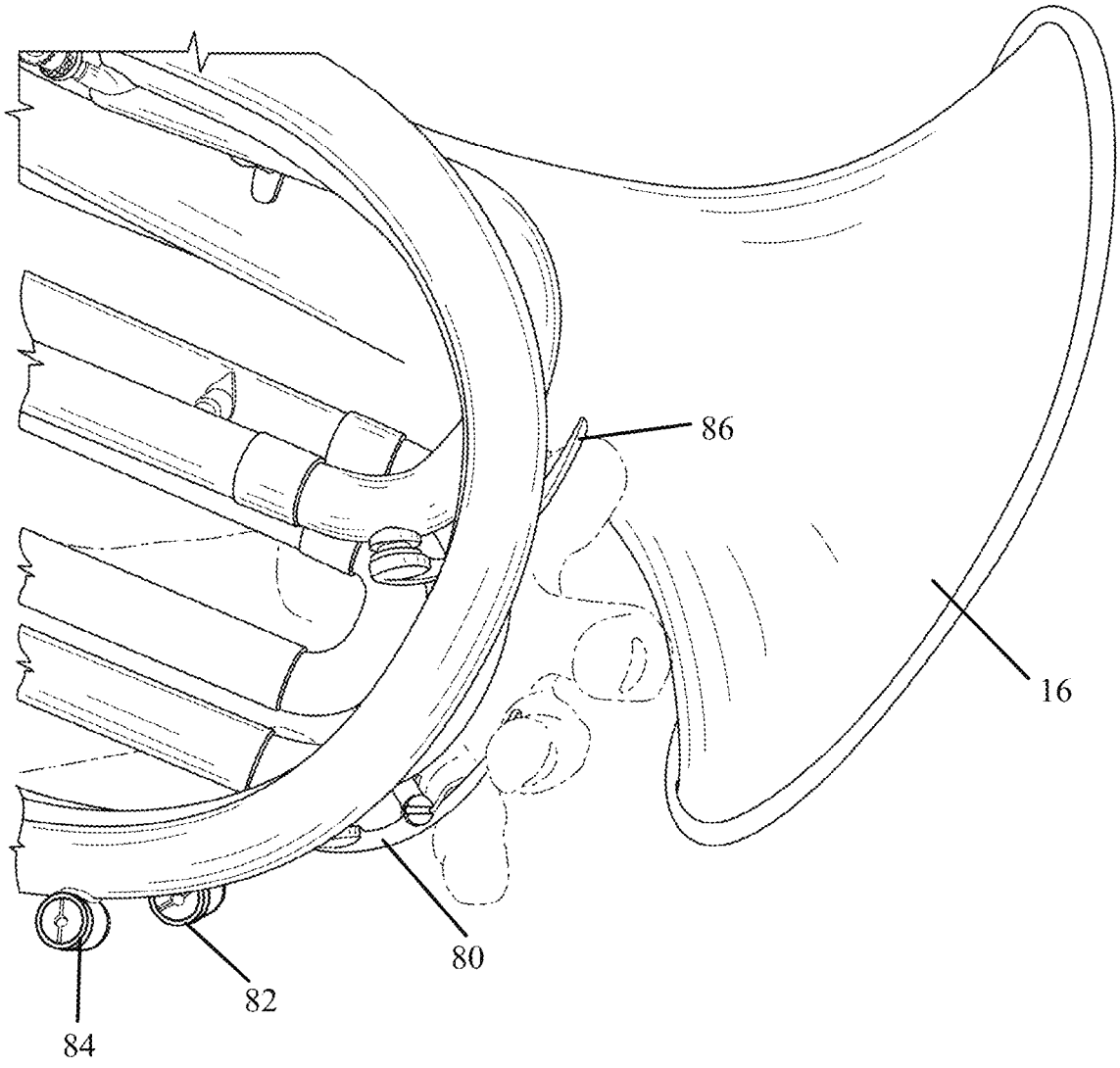
FIG. 7 shows another view of the water keys.
Figure 8:
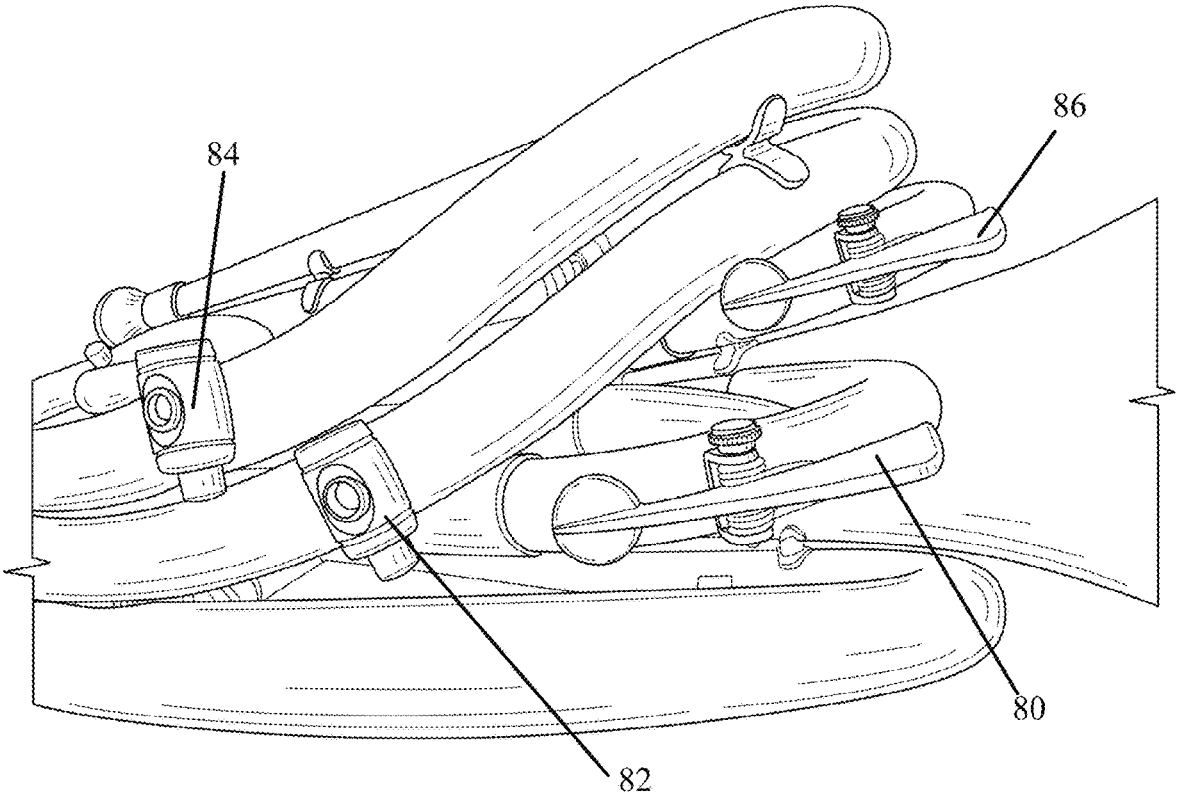
FIG. 8 shows a bottom view of the two different water keys of FIGS. 6-7.
Figure 9:
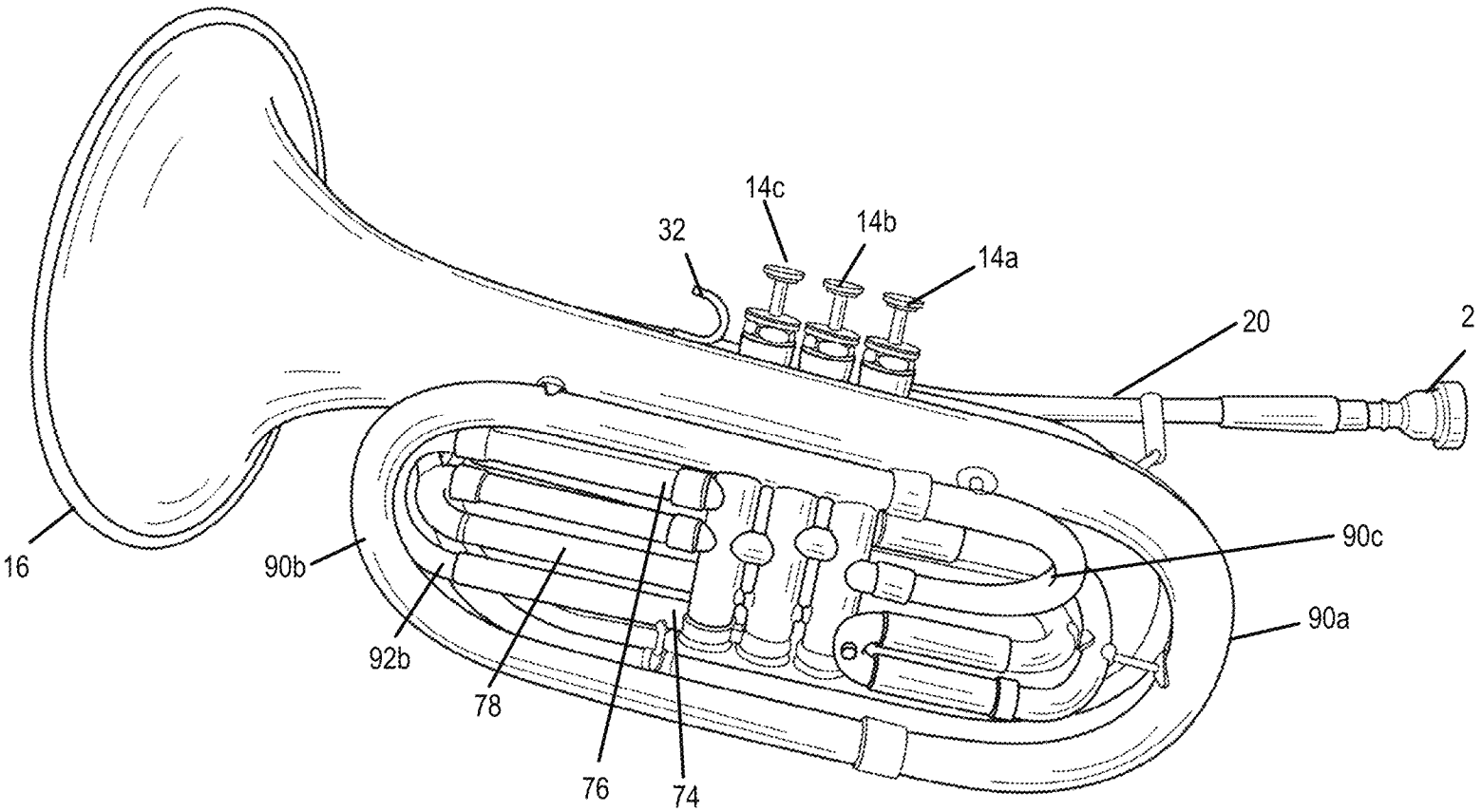
FIG. 9 shows another side perspective view of the mellophone of an embodiment of the present invention.
Figure 10:
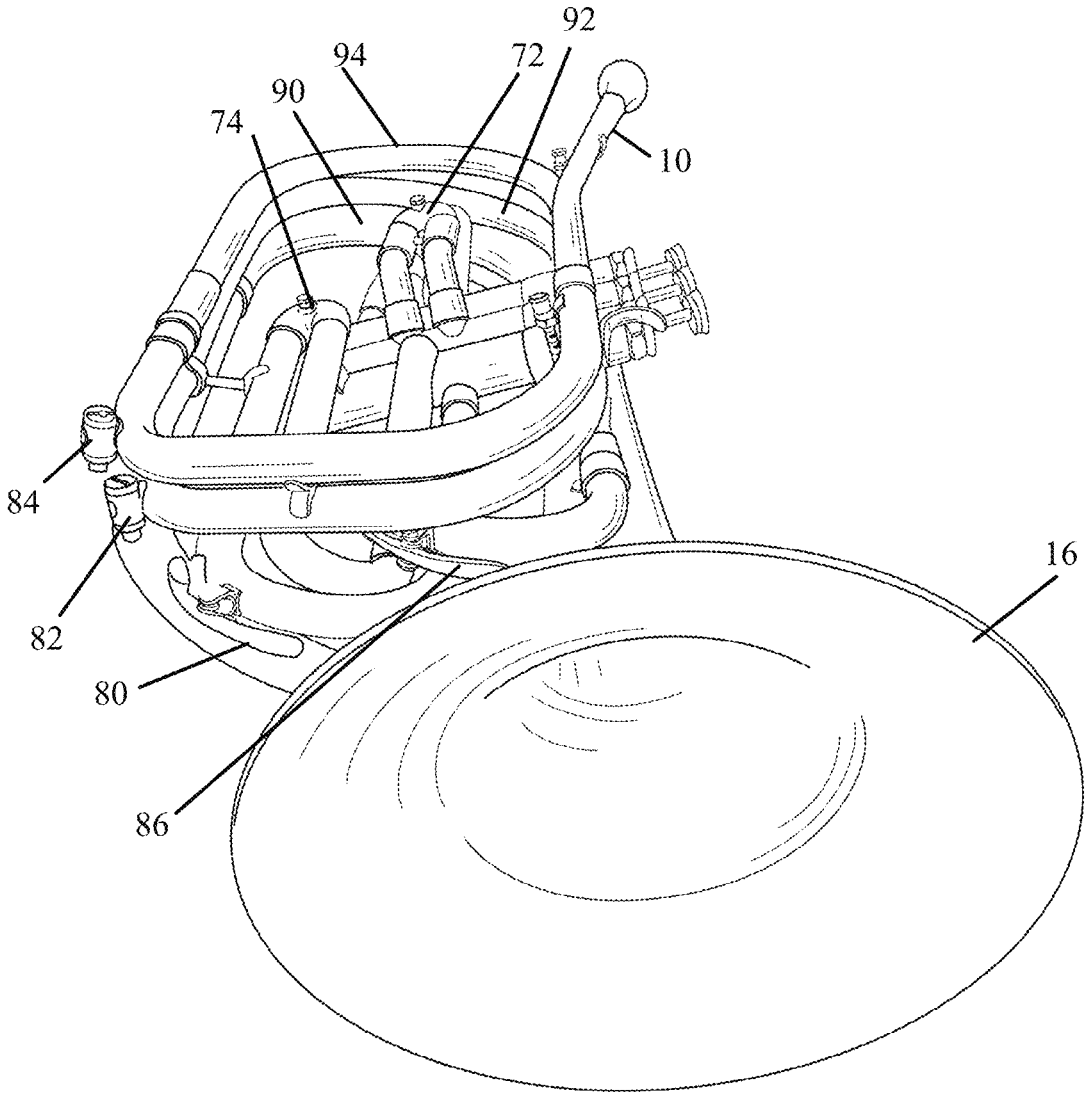
FIG. 10 shows a bottom perspective view of the mellophone of an embodiment of the present invention.
Figure 11:
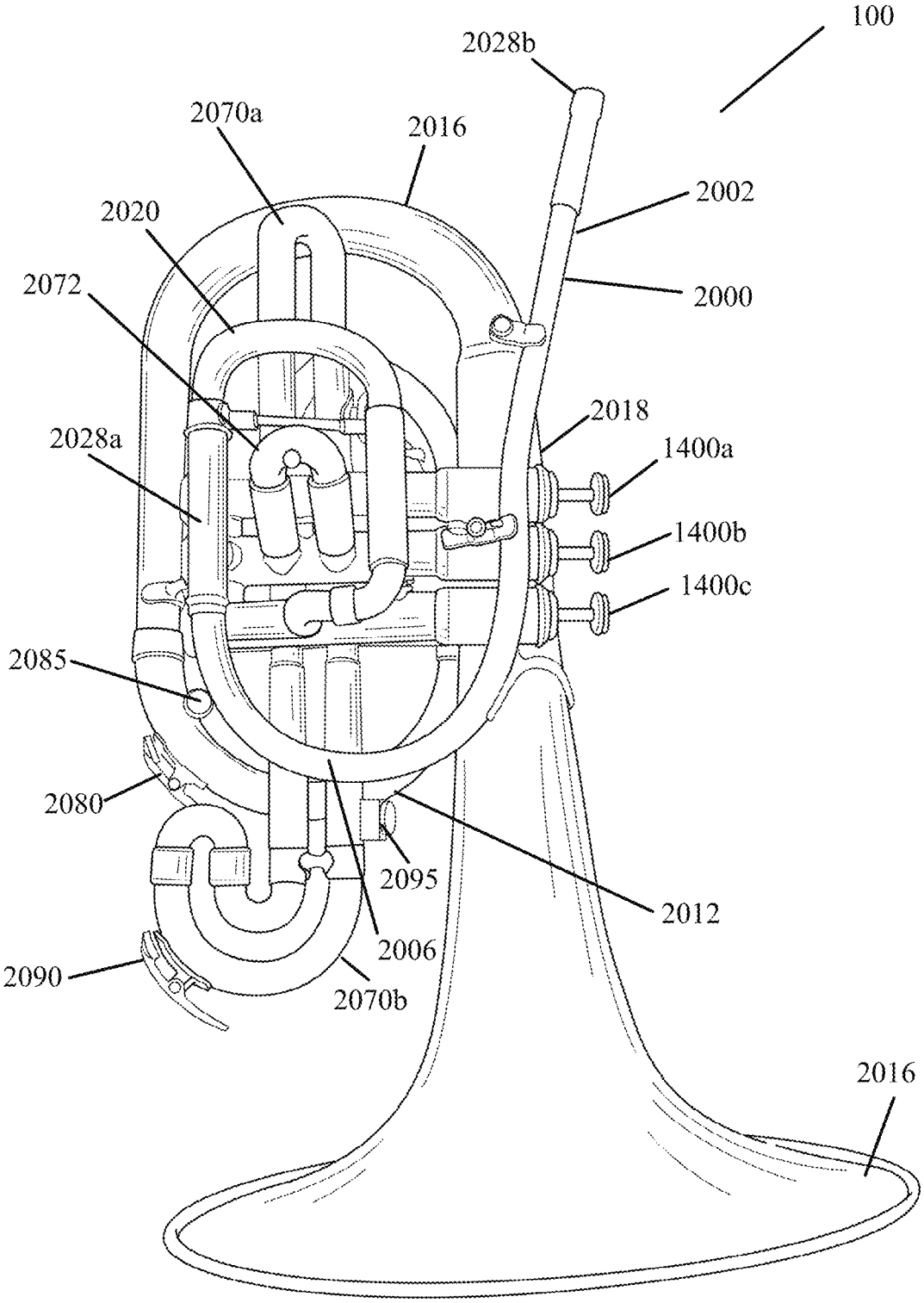
FIG. 11 shows a side view of a mellophone of an alternate embodiment.
Figure 12B:
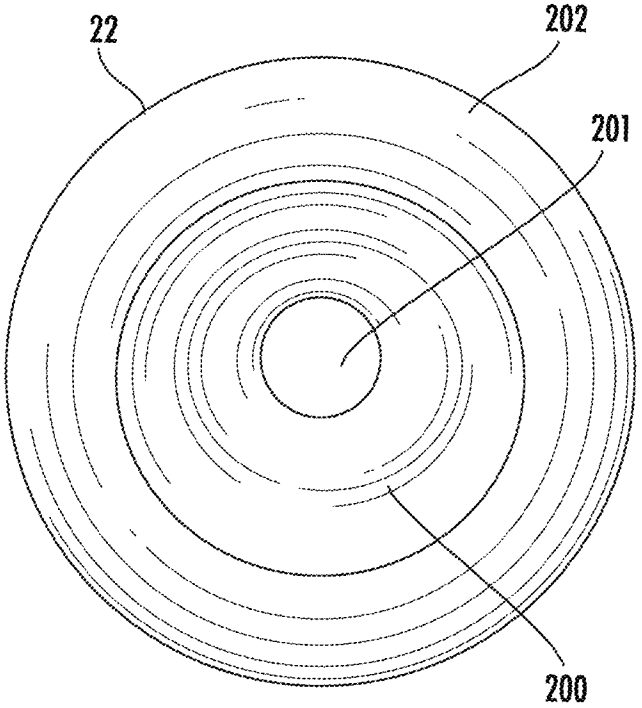
FIG. 12B shows a top plan view of the bore measurements a trumpet mouthpiece.
Figure 12A:
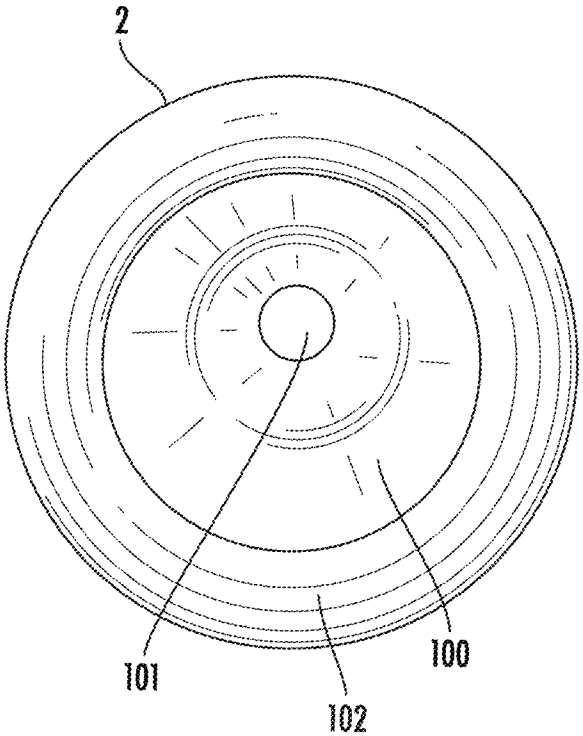
FIG. 12A shows a top plan view of the bore measurements of the horn mouthpiece.
Figure 13A:
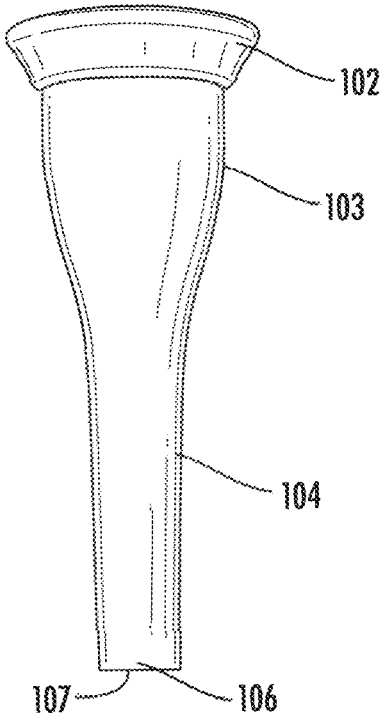
FIG. 13A shows another view of the horn mouthpiece.
Figure 13B:
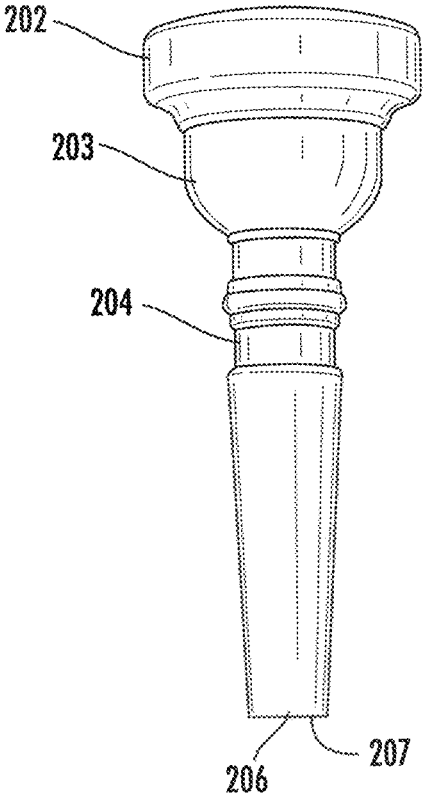
FIG. 13B shows another view of the trumpet mouthpiece.

The three piston valves 14*a*-14*c* are formed within the tubing segments 90, 92, 94 of mellophone 1 (see FIG. 5). Along the tubing segments 92, 94, specifically tubing loop segments 92*b*, 94*a* of mellophone 1 are two different types of water keys (see FIGS. 6-8)—a lever type water key 80, 86 and an amado type water key 82, 84, so that water accumulating within the mellophone 1 can be emptied quickly using the left hand of the player. While four total water keys are shown, the number can vary.

The leadpipe 20 shown in FIG. 1A is attached to the second tubing loop segment 94*b* can be replaced with leadpipe 10 to allow an attachment of a different mouthpiece. The difference between the leadpipe 10 and leadpipe 20 is the end first end of the leadpipe allowing for the attachment of different diameter mouthpieces. Leadpipe 10 has a first end 10*a* and a second end 10*b*. The first end 10*a* receives the mouthpiece 2, which is preferably a French horn mouthpiece, and the second end 10*b* is attached to the second tubing loop segment 94*b*. The angle 12 of the first end 10*a* of the leadpipe 10 relative to third tubing segment 94 can be the same or different than the angle 26 of the leadpipe 20 when attached to the mellophone 1.

In another embodiment, shown in FIGS. 11-14, mellophone 100 has a silver finish that creates a brighter sounding tone than conventional mellophones. Mellophone 100 comprises a bell 2016 connected to first tubing segment 2018, first tubing loop segment 2016, second tubing segment 2014, second tubing loop segment 2012, having spit valve 2080 and amado type water key 2085, connects to piston valve 1400*c*. Tuning slide 2020 radially extends from piston valve 1400*c* and connects to a first end 2028*a* of French horn leadpipe 2000. French leadpipe 2000 has loop 2006, extending to a second end 2028*b* which receives French horn mouthpiece 2002.

U-shaped tuning slide 2072 is perpendicular to tuning slide 2020 and is a closed loop that radially extends from, and connects back to piston valve 1400*b*. Tuning slide 2070 has a first end 2070*a* and a second end 2070*b* and longitudinally extends the length of the mellophone 100 parallel to first tubing segment 2018 and perpendicular to piston valves 1400*a*-1400*c*. On the second end 2070*b* is a water key 2090 and amado type water key 2095.

The French horn leadpipe 10 and trumpet leadpipe 20 are removably attached to the tubing segments 90, 92, 94 of mellophone 1, 100 by screws and a brace (not shown). With the French horn leadpipe 10 and trumpet leadpipe 20 at an angle 12, 26 relative to the tubing segment 94 of the mellophone 1, 100 and the bell 16, 2016 of the mellophone 1, 100, the player can have a natural body position when facing spectators or stands of spectators such that the bell 16, 2016 is pointed towards the stands and the player does not have to bend backwards to ensure that the bell 16, 2016 is pointed upwards (see FIGS. 9-10). The bell 16. 2016 may be made of carbon fiber or other materials which further reduce the weight of mellophone 1.

FIGS. 3A-3B, 4A-4B, 12A, 12B, 13A and 13B show trumpet mouthpiece 22 and French horn mouthpiece 2.

Trumpet mouthpiece 22 has a hollow parabolic cup 203 with a rim 202, which is connected to a throat 204 which has an end 206 which is received by a leadpipe 20. The parabolic cup 203 has an inner bore 200 which terminates in an orifice 201 in the throat 204. The diameter of the inner bore 200 within the parabolic cup 203 of the trumpet mouthpiece is approximately 0.0830 inches and the diameter of the rim 202 is approximately 1.270 inches. The diameter of the orifice 201 between the parabolic cup 203 and the throat 204 is approximately 0.200 inches in diameter. The orifice 207 at the end 206 is approximately 0.595 inches in diameter.

French horn mouthpiece 2 has a conical funnel 103 with a rim 102, which is connected to a throat 104 which has an end 106 received by a leadpipe 10. The conical funnel 103 has an inner bore 100 which terminates in an orifice 101 in the throat 104. The diameter of the inner bore 200 within the conical funnel 103 of the French horn mouthpiece is approximately 0.860 inches and the diameter of the rim 102 is approximately 1.170 inches. The diameter of the orifice 101 between the conical funnel 103 and the throat 104 is approximately 0.135 inches in diameter. The orifice 107 at the end 106 is approximately 0.490 inches.

One of ordinary skill in the art understands that a difference of 0.03-0.05" in diameter, especially for connection to an instrument relying on air pressure makes a significant difference in response and playability of an instrument and has an effect on sound, feel, intonation, and the flow of air, or backpressure, through the mellophone 1, 100. The difference in the size of the mouthpieces is therefore difficult for players who commonly use one or the other piece to switch to the other of the mouthpieces and still maintain sound and intonation.

Since the leadpipe of the mellophone of the embodiments of the present invention can be interchanged, a player can user a trumpet mouthpiece of a French horn mouthpiece without an additional adapter. Without having to use an adapter, the intonation and sound are significantly more stable and tunable, as opposed to the prior art and players can user their own, familiar mouthpieces to achieve a stable, deep and mellow sound from the instrument.

It should be noted that since the mellophone of the present invention is pitched in real F, the need of the player to adjust various slides for correct intonation is eliminated.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A portable mellophone comprising:

a bell;

a first tubing segment connected to the bell;

a second tubing segment connected to the first tubing segment;

a third tubing segment connected to the second tubing segment;

three piston valves connected to the first tubing segment, the second tubing segment and the third tubing segment, each of the three piston valves having a tuning slide;

a removable lead pipe having a first end configured for mating with a selected mouthpiece without an adapter and a second end connected to the third tubing segment;

wherein the first end of the removable lead pipe is at an angle relative to the third tubing segment;

wherein the selected mouthpieces are selected from a conical funnel mouthpiece and a parabolic cup mouthpiece.

2. The portable mellophone of claim 1, wherein the conical funnel mouthpiece is a French horn mouthpiece and the parabolic cup mouthpiece is a trumpet mouthpiece.

3. The of claim 1 wherein the mellophone is pitched in true F.

4. The portable mellophone of claim 1, further comprising water keys on the third tubing segment.

5. The portable mellophone of claim 4, wherein the water keys are selected from a group consisting of: a lever type water key and an amado type water key.

6. The portable mellophone of claim 1, wherein the mellophone weighs no more than 1.81 kg.

7. The portable mellophone of claim 1, wherein the conical funnel mouthpiece comprises a conical funnel defining an inner bore having a rim, a throat with an orifice connected to the conical funnel and an end adapted to be received by the leadpipe.

8. The portable mellophone of claim 7, wherein the inner bore has a diameter of approximately 0.860 inches and the end adapted to be received by the leadpipe has a diameter of approximately 0.490 inches.

9. The portable mellophone of claim 1, wherein the parabolic cup mouthpiece comprises a parabolic cup defining an inner bore having a rim, a throat with an orifice connected to the parabolic cup and an end adapted to be received by the leadpipe.

10. The portable mellophone of claim 9, wherein the inner bore has a diameter of approximately 0.830 inches and the end adapted to be received by the leadpipe has a diameter of approximately 0.595 inches.

11. A portable mellophone instrument comprising:

a bell;

a first piston valve;

a second piston valve;

a third piston valve;

a first tubing segment having a first tubing loop segment, a second tubing loop segment, and a third tubing loop segment connected to the first piston valve;

a second tubing segment, having a first tubing loop segment, a second tubing loop segment, wherein the second tubing segment longitudinally extends from the second piston valve;

a third tubing segment, having a first tubing loop segment and a second tubing loop segment, wherein the tubing segment is connected to the third piston valve;

a leadpipe having a first end and a second end wherein the first end of the leadpipe is connected to the third tubing segment and the second end of the leadpipe is adapted to receive a selected mouthpiece.

12. The mellophone of claim 11, wherein a total length of the first tubing segment, the second tubing segment, and the third tubing segment is 3.66 meters.

13. The mellophone of claim 11, wherein the selected mouthpiece is a conical funnel mouthpiece or a parabolic cup mouthpiece.

14. The mellophone of claim 11, wherein the first end of the lead pipe is at an angle relative to the third tubing segment.

* * * * *